US009126207B2

(12) United States Patent
Parkinson et al.

(10) Patent No.: US 9,126,207 B2
(45) Date of Patent: Sep. 8, 2015

(54) SEPARATOR FOR SEPARATING A MULTIPHASE MIXTURE

(75) Inventors: David J. Parkinson, Clevedon (GB); Kevin E. Collier, Kaysville, UT (US)

(73) Assignee: Specialist Process Technologies Limited, Tortola (VG)

( * ) Notice: Subject to any disclaimer, the term of this patent is extended or adjusted under 35 U.S.C. 154(b) by 793 days.

(21) Appl. No.: 13/280,920

(22) Filed: Oct. 25, 2011

(65) Prior Publication Data

US 2012/0088647 A1 Apr. 12, 2012

Related U.S. Application Data

(63) Continuation-in-part of application No. 12/765,520, filed on Apr. 22, 2010, now abandoned.

(51) Int. Cl.

| | |
|---|---|
| ***B04B 1/06*** | (2006.01) |
| ***B04B 1/04*** | (2006.01) |
| ***B04B 1/14*** | (2006.01) |
| ***B04B 7/02*** | (2006.01) |

(Continued)

(52) U.S. Cl.

CPC ... *B04B 1/04* (2013.01); *B04B 1/14* (2013.01); *B04B 7/02* (2013.01); *B04B 7/08* (2013.01); *B04B 7/12* (2013.01); *B04B 11/06* (2013.01); *B04B 13/00* (2013.01); *B04B 15/06* (2013.01); *B04B 2013/006* (2013.01)

(58) Field of Classification Search

CPC ..... B04B 1/04; B04B 1/06; B04B 2013/006
USPC ..... 494/2, 3, 56
See application file for complete search history.

(56) References Cited

U.S. PATENT DOCUMENTS

| | | | |
|---|---|---|---|
| 2,688,437 | A | 9/1954 | Georges |
| 3,369,742 | A | 2/1968 | Weiland |

(Continued)

FOREIGN PATENT DOCUMENTS

| | | | |
|---|---|---|---|
| GB | 1338369 | A | 11/1973 |
| SU | 1158243 | | 5/1985 |
| WO | WO-2011131540 | A1 | 10/2011 |

OTHER PUBLICATIONS

International Search Report for Application PCT/EP2011/055845 dated Aug. 3, 2011.

(Continued)

*Primary Examiner* — Charles Cooley
*Assistant Examiner* — Marc C Howell
(74) *Attorney, Agent, or Firm* — Honigman Miller Schwartz and Cohn LLP

(57) ABSTRACT

A separator for separating a multiphase mixture comprising a pressure vessel supported for rotation within a casing containing a gas which may be held at an elevated temperature or pressure. A plurality of vanes is disposed within the pressure vessel. The pressure vessel has an inlet, a first phase outlet and a plurality of second phase outlets disposed radially outwardly of the first phase outlet with respect to a separator axis. A regulator is provided in the form of pressure-activated nozzles to regulate flow through the second phase outlets. In use, a mixture of solids and liquid is fed into the pressure vessel and the pressure vessel is spun within the gas causing solids to accumulate in the vicinity of the second phase outlets. The pressure-activated nozzles are repeatedly opened and closed to expel the accumulated solids.

24 Claims, 15 Drawing Sheets

(51) Int. Cl.

| | |
|---|---|
| ***B04B 7/08*** | (2006.01) |
| ***B04B 7/12*** | (2006.01) |
| ***B04B 11/06*** | (2006.01) |
| ***B04B 13/00*** | (2006.01) |
| ***B04B 15/06*** | (2006.01) |

(56) References Cited

U.S. PATENT DOCUMENTS

| | | | | |
|---|---|---|---|---|
| 3,563,454 | A | 2/1971 | Saget | |
| 4,508,530 | A | 4/1985 | Schlegel et al. | |
| 5,908,376 | A | 6/1999 | Macaluso et al. | |
| 6,033,564 | A | 3/2000 | Kirker et al. | |
| 6,589,155 | B2 * | 7/2003 | Dolecek | 494/84 |
| 7,060,017 | B2 * | 6/2006 | Collier | 494/3 |
| 2004/0178138 | A1 | 9/2004 | Kirker et al. | |
| 2008/0041772 | A1 | 2/2008 | Sweat et al. | |
| 2008/0171645 | A1 | 7/2008 | Borgstrom et al. | |
| 2008/0271654 | A1 * | 11/2008 | Cavaliere et al. | 110/221 |

OTHER PUBLICATIONS

English translation of a Chinese Office Action for Application No. 201180020332.0 dated Jul. 16, 2013.

International Search Report and Written Opinion for Application No. PCT/GB2012/052611 dated Mar. 21, 2013.

* cited by examiner

SEPARATOR FOR SEPARATING A MULTIPHASE MIXTURE

CROSS REFERENCE TO RELATED APPLICATIONS

This application in a continuation-in-part of U.S. patent application Ser. No. 12/765,520 filed on Apr. 22, 2010.

FIELD OF THE INVENTION

This invention relates to a separator, and is particularly, although not exclusively, concerned with a rotary separator for separating phases of a multiphase mixture.

BACKGROUND OF THE INVENTION AND PRIOR ART

Centrifugal separators for separating multiphase mixtures into their component phases are well known.

Existing centrifugal separators often rely on a batch separation process. This involves separating phases of a mixture into different regions of the separator. Once separation is complete, the separator is stopped and each phase can be removed from the separator. A batch process is often undesirable since it involves periodic interruption of the separation process.

Alternatively, each phase may be removed continuously via separate outlets from a separator. With such methods, removal rates of each phase need to be constantly monitored to ensure that the separation process remains effective. Furthermore, solids and emulsion can build up during the separation process and fill the separator and swamp the rotor.

The term "phase" may refer, in the context of this specification, to the particular state of a substance, for example, whether a substance is a solid, liquid or gas. The term "phase" may also be used to distinguish different substances, for example, immiscible liquids or solids from liquids.

SUMMARY OF THE INVENTION

According to a first aspect of the present invention there is provided a separator for separating a multiphase mixture comprising a pressure vessel, which defines a separator axis, a support for supporting the pressure vessel for rotation about the separator axis, at least one vane disposed within and coupled for rotation with the pressure vessel and a flow regulator, wherein the pressure vessel has an inlet, a first phase outlet and a plurality of second phase outlets disposed radially outwardly of the first phase outlet with respect to the separator axis and the flow regulator is arranged to regulate flow through the second phase outlets.

The flow regulator may comprise a plurality of pressure-activated nozzles disposed respectively at the second phase outlets.

Each pressure-activated nozzle may comprise a non-return valve for preventing flow into the pressure vessel. The non-return valve may comprise a bias which biases the non-return valve towards a closed position.

The pressure-activated nozzles may be provided in a radially outer wall of the pressure vessel.

A plurality of accumulators may be disposed within the pressure vessel adjacent respective second phase outlets. The accumulators may comprise funnels which converge in a radially outward direction towards the respective second phase outlets.

The separator may further comprise a pressure regulator for regulating pressure within the pressure vessel. The pressure regulator may comprise a flow controller for controlling flow through the first phase outlet.

The separator may comprise a plurality of vanes. The vanes may be flat circular discs that are coaxial with, and extend radially outwardly from, the separator axis. Alternatively, the vanes may be cone shaped discs that are coaxial with, and extend radially outwardly from, the separator axis.

Each disc may have an array of apertures arranged circumferentially about the separator axis, wherein the apertures of adjacent discs are angularly offset with respect to one another. The apertures may be perforations.

Spacer fins may extend between adjacent discs and the spacer fins may be arranged with respect to the apertures to form staggered and/or interconnected flow passages from the pressure vessel inlet to the first phase outlet.

At least one emulsion outlet may be disposed radially outwardly of the first phase outlet and radially inwardly of the second phase outlets. The or each emulsion outlet may comprise a tube which extends radially outwardly with respect to the separator axis, wherein the or each tube is in fluid communication with an emulsion discharge passage which extends along the separator and which exhausts through an end of the separator for removing emulsion from the separator.

The separator may further comprise a rotor shaft provided with spray nozzles for supplying fluid into the interior of the pressure vessel. The spray nozzles may be arranged such that they are directed towards the second phase outlets.

The separator may further comprise a third phase outlet disposed radially outwardly of the first phase outlet and radially inwardly of the second phase outlets.

The separator may further comprise a control system which is arranged to control the radial position of an interface between first and third phases within the pressure vessel.

The control system may comprise a regulator associated with least one of the first phase and the third phase outlets for varying pressure at said outlet.

The control system may comprise a monitoring means for determining the proportion of first phase and/or second phase of a mixture of first and second phases at a predetermined reference position within the vessel.

The reference position may be radially outward of the first phase outlet and may be radially inward of the third phase outlet. The monitoring means may comprise a density meter.

The monitoring means may further comprise a sample port disposed at the predetermined reference position.

The sample port may extend in the radial direction with respect the separator axis such that the sample port extends over a predetermined radial extent. A plane of the sample port may be inclined with respect to the separator axis. The angle of inclination may be at least 20 degrees with respect to the separator axis.

The separator may further comprise a sealable casing within which the pressure vessel is rotatably mounted. The casing may comprise a sump in the lower region of the casing from which the second phase is discharged.

Means may be provided for introducing fluid under pressure between the casing and the pressure vessel. The fluid may be a gas.

The separator may comprise a pressure regulator for regulating pressure between the casing and the pressure vessel.

According to a second aspect of the present invention there is provided a method of separating a mixture comprising a first phase and a second phase using a separator for separating a multiphase mixture comprising a pressure vessel, which defines a separator axis, a support for supporting the pressure vessel for rotation about the separator axis, at least one vane disposed within and coupled for rotation with the pressure vessel and a flow regulator, wherein the pressure vessel has an inlet, a first phase outlet and a plurality of second phase outlets disposed radially outwardly of the first phase outlet with respect to the separator axis and the flow regulator is arranged to regulate flow through the second phase outlets comprising the steps:

(a) generating a positive pressure difference across the second phase outlets such that flow through the second phase outlets is prevented;

(b) spinning the pressure vessel such that the second phase accumulates in the vicinity of the second phase outlets;

(c) generating a negative pressure difference across the second phase outlets such that flow through the second phase outlets is permitted.

Step (a) may comprise the step of restricting or preventing flow though the first phase outlet to increase pressure within the pressure vessel.

Step (a) may comprise increasing the external pressure on the pressure vessel. The external pressure may be sufficient to counteract the internal pressure of the pressure vessel and the centrifugal force acting on the pressure vessel.

Steps (a) to (c) may be repeated to remove accumulated second phase through the second phase outlets.

According to a third aspect of the invention there is provided a method of separating a mixture comprising a first phase, a second phase and third phase using a separator for separating a multiphase mixture comprising a pressure vessel, which defines a separator axis, a support for supporting the pressure vessel for rotation about the separator axis, at least one vane disposed within and coupled for rotation with the pressure vessel and a flow regulator, wherein the pressure vessel has an inlet, a first phase outlet, a plurality of second phase outlets disposed radially outwardly of the first phase outlet with respect to the separator axis and a third phase outlet disposed radially outwardly of the first phase outlet and radially inwardly of the second phase outlets with respect to the separator axis, the flow regulator being arranged to regulate flow through the second phase outlets, wherein the method comprises the steps:

(a) spinning the pressure vessel such that an interface is formed between the first and third phases within the vessel;

(b) determining a parameter corresponding to a proportion of at least one of the first and second phases of a mixture of first and second phases at a predetermined reference (c) position within the vessel; and controlling the radial position of the interface in accordance with the parameter.

The step of controlling the radial position of the interface may comprise varying the pressure at the first phase and/or third phase outlets.

The parameter may comprise the density of the phase or mixture of phases at the reference position.

The step of controlling the radial position of the interface may comprise the step of comparing the density of the phase or mixture of phases at the reference position against a predetermined density, and varying the pressure at the first and/or third phase outlets such that the radial position of the interface moves towards the reference position.

According to a fourth aspect of the invention there is provided a separator for separating a multiphase mixture comprising: a pressure vessel, which defines a separator axis; a support for supporting the pressure vessel for rotation about the separator axis; at least one vane disposed within and coupled for rotation with the pressure vessel; a flow regulator; and a control system, the pressure vessel having an inlet, a first phase outlet and a second phase outlet disposed radially outwardly of the first phase outlet with respect to the separator axis, wherein the flow regulator is arranged to regulate flow through at least one of the first and second phase outlets and the control system is arranged to control the radial position of an interface between first and second phases within the pressure vessel. The first and second phases may be liquid phases. The regulator and/or control system may be in accordance with the regulator and/or control system of the first aspect of the invention.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION OF PREFERRED EMBODIMENTS

Figure 1:
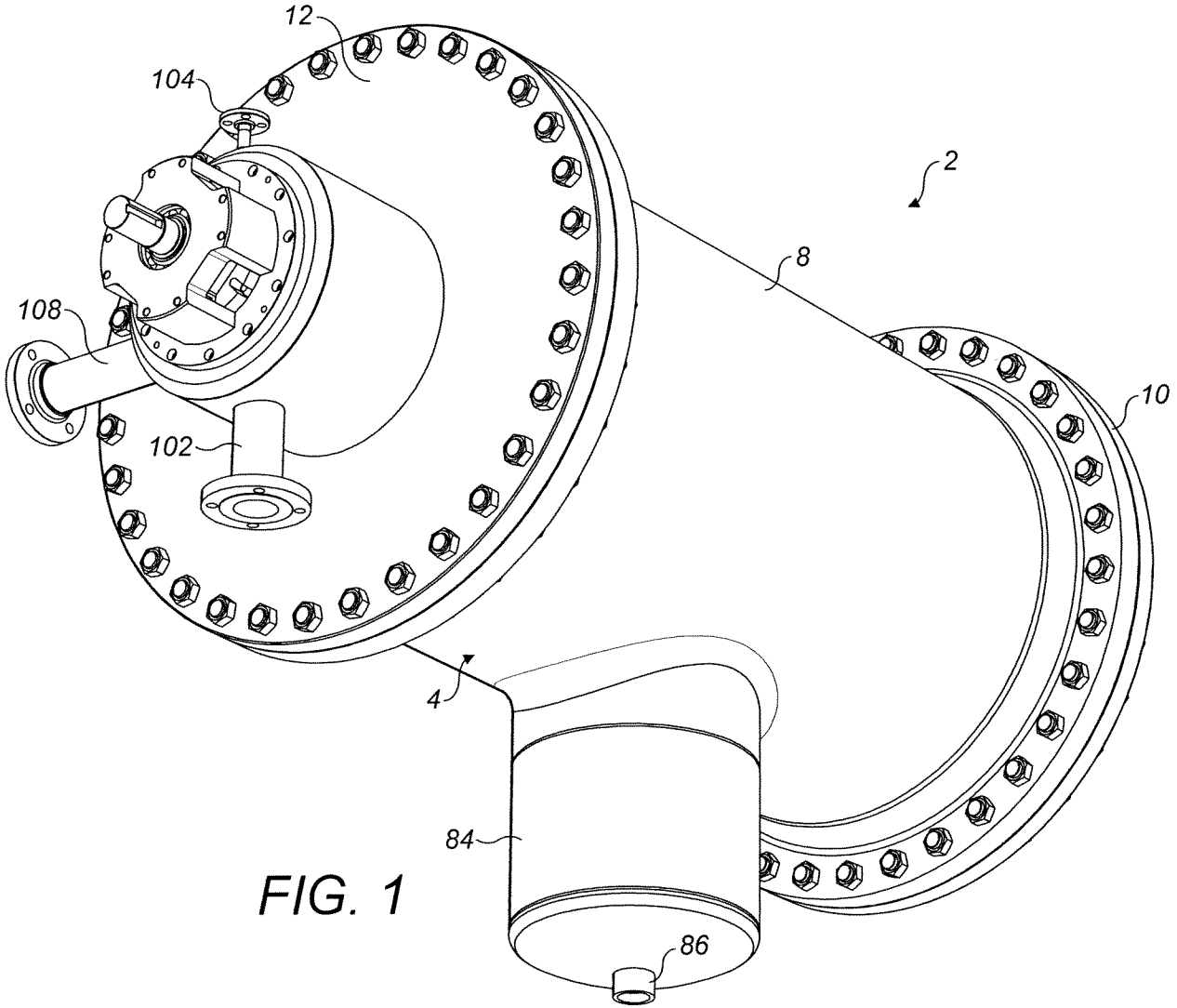
FIG. 1 is a perspective view of a separator.
Figure 2:
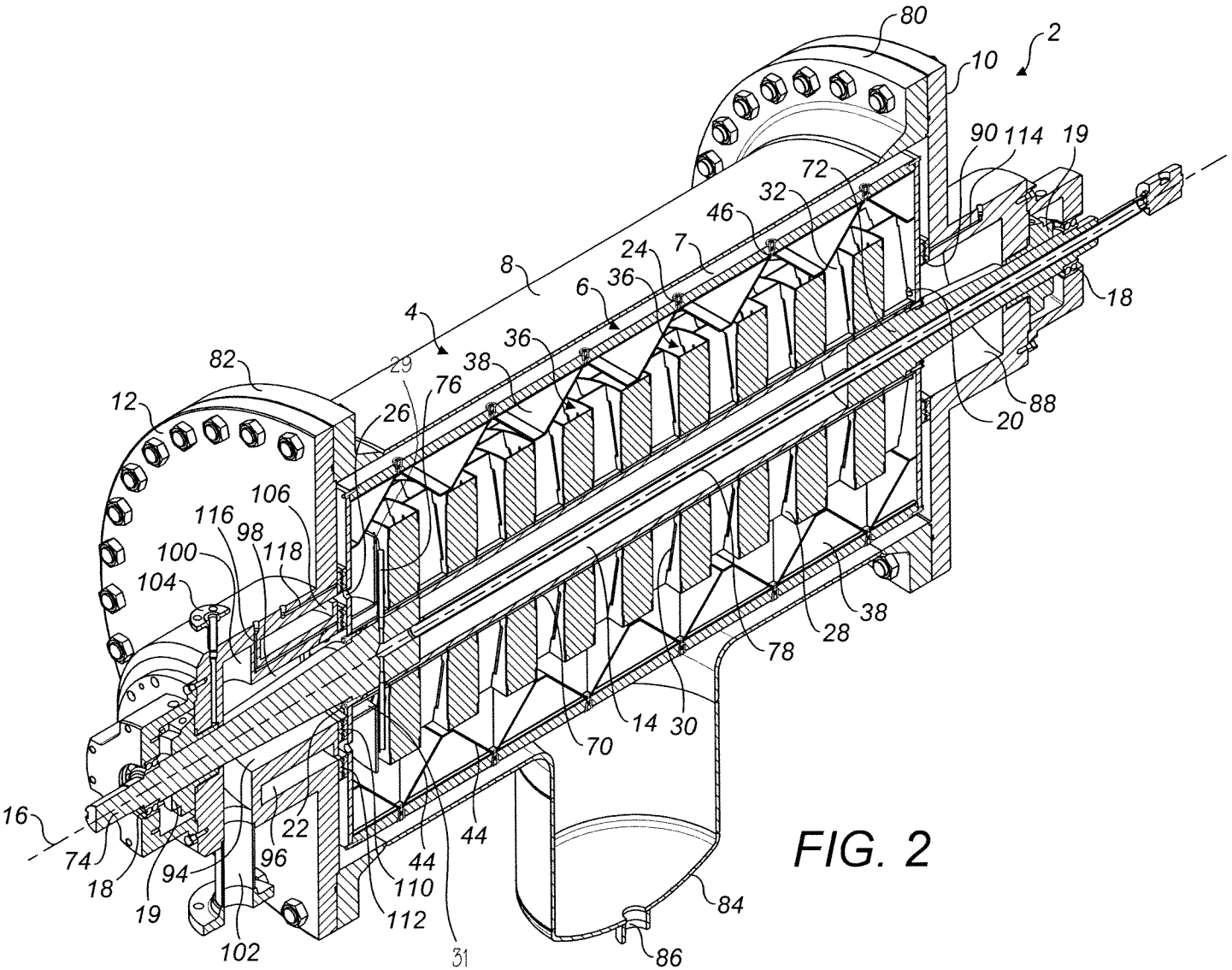
FIG. 2 is perspective sectional view of the separator shown in FIG. 1.

FIGS. 1 and 2 show a separator 2 comprising an outer casing 4 which supports a rotor 6 for rotation therein. The outer casing 4 comprises a cylindrical section 8 which is closed at each end by an inlet flange 10 and an outlet flange 12.

The rotor 6 comprises a pressure vessel in the form of a cylindrical drum 7, carried by a shaft 14. The shaft 14 is supported by bearings 18 in the respective flanges 10, 12 for rotation about a separator axis 16. The drum 6 is provided with a drum inlet 20, a first phase outlet 22, a plurality of second phase outlets 24 and a third phase outlet 26.

Figure 3:
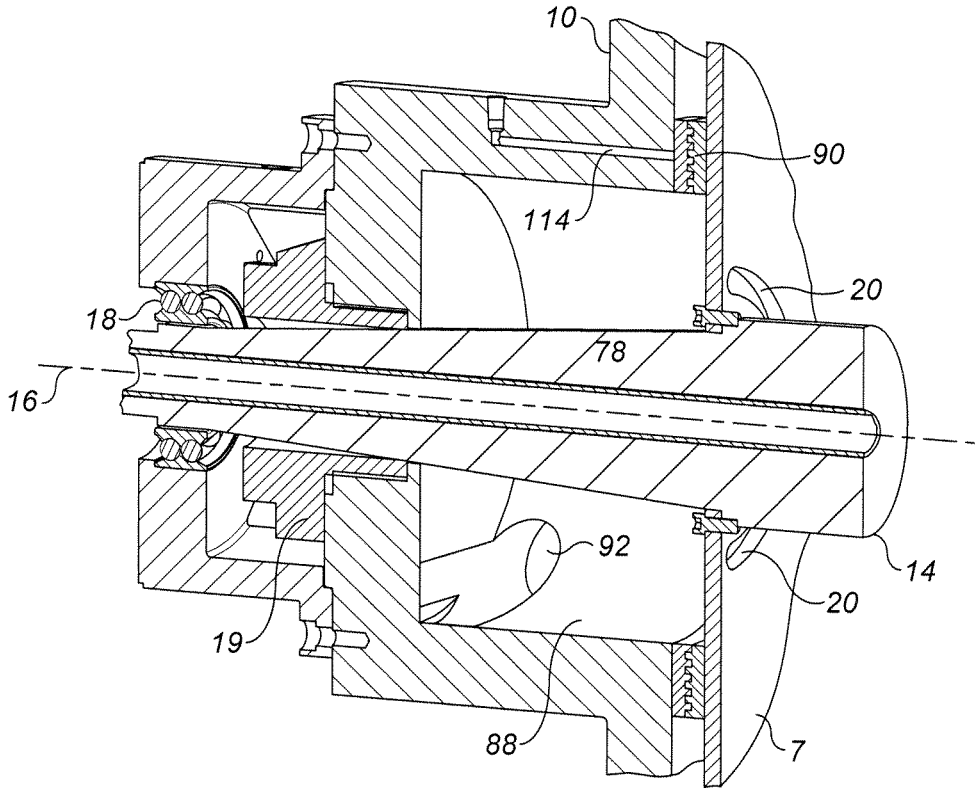
FIG. 3 is an enlarged perspective sectional view of an end of the separator shown in FIG. 1.

Referring to FIG. 3, the drum inlet 20 comprises four arcuate and circumferentially spaced apertures which extend circumferentially about the axis 16.

The first phase outlet 22 is at the end of the drum 7 opposite the drum inlet 20. The first phase outlet 22 comprises an annular aperture which extends circumferentially about the axis 16. The second phase outlets 24 are formed through the radially outer wall of the drum 7. The second phase outlets 24 are arranged in an axially and circumferentially spaced array. The third phase outlet 26 is disposed adjacent the first phase outlet 22 and comprises a plurality of apertures arranged circumferentially about the axis 16. The third phase outlet 26 is coaxial with the first phase outlet 22 but is spaced radially outwardly of the first phase outlet 22 and radially inwardly of the second phase outlets 24.

A stack of discs 28 (the embodiment shown in the Figures comprises eighteen discs 28) is arranged along the length of the shaft 14. The discs 28 extend perpendicularly to the separator axis 16 and are secured to the shaft 14. The discs 28 are thus coupled for rotation with the drum 7.

Figure 6:
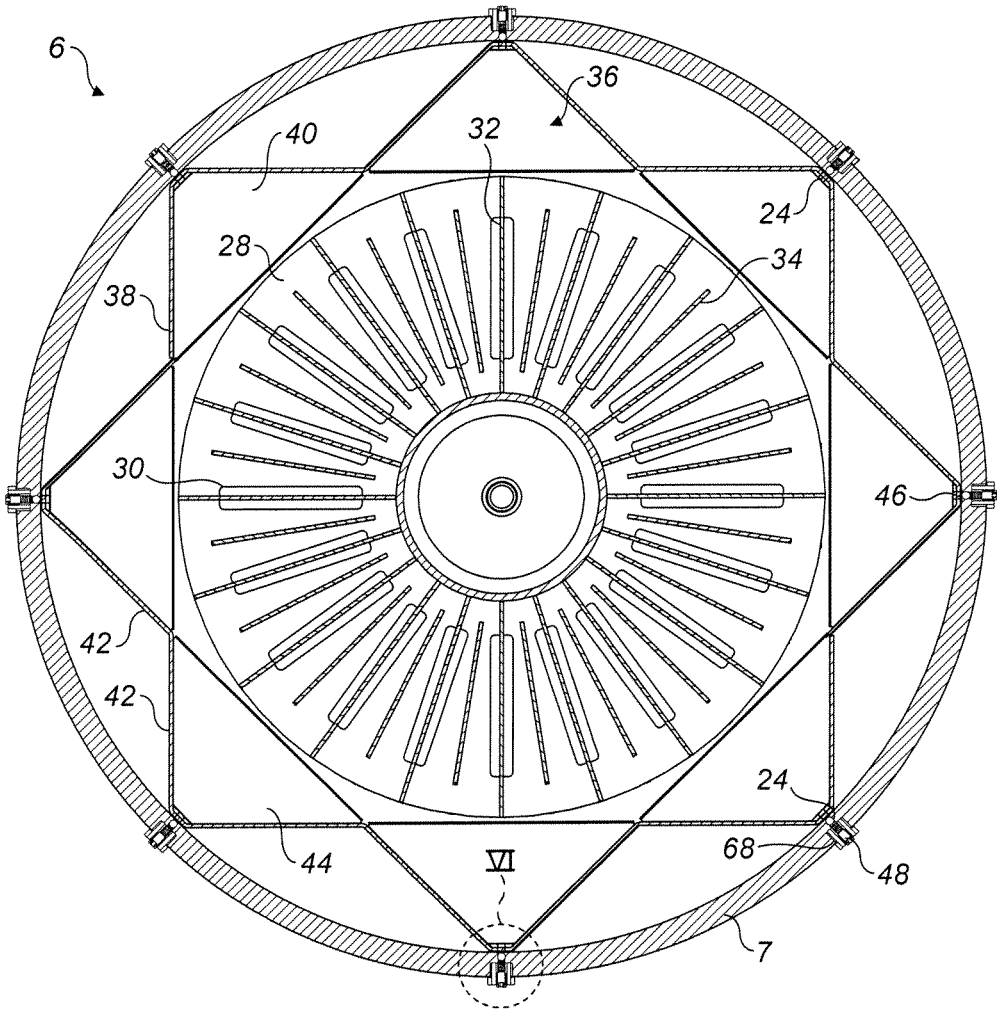
FIG. 6 is a radial sectional view of the part of the rotor shown in FIG. 2.
Figure 8:
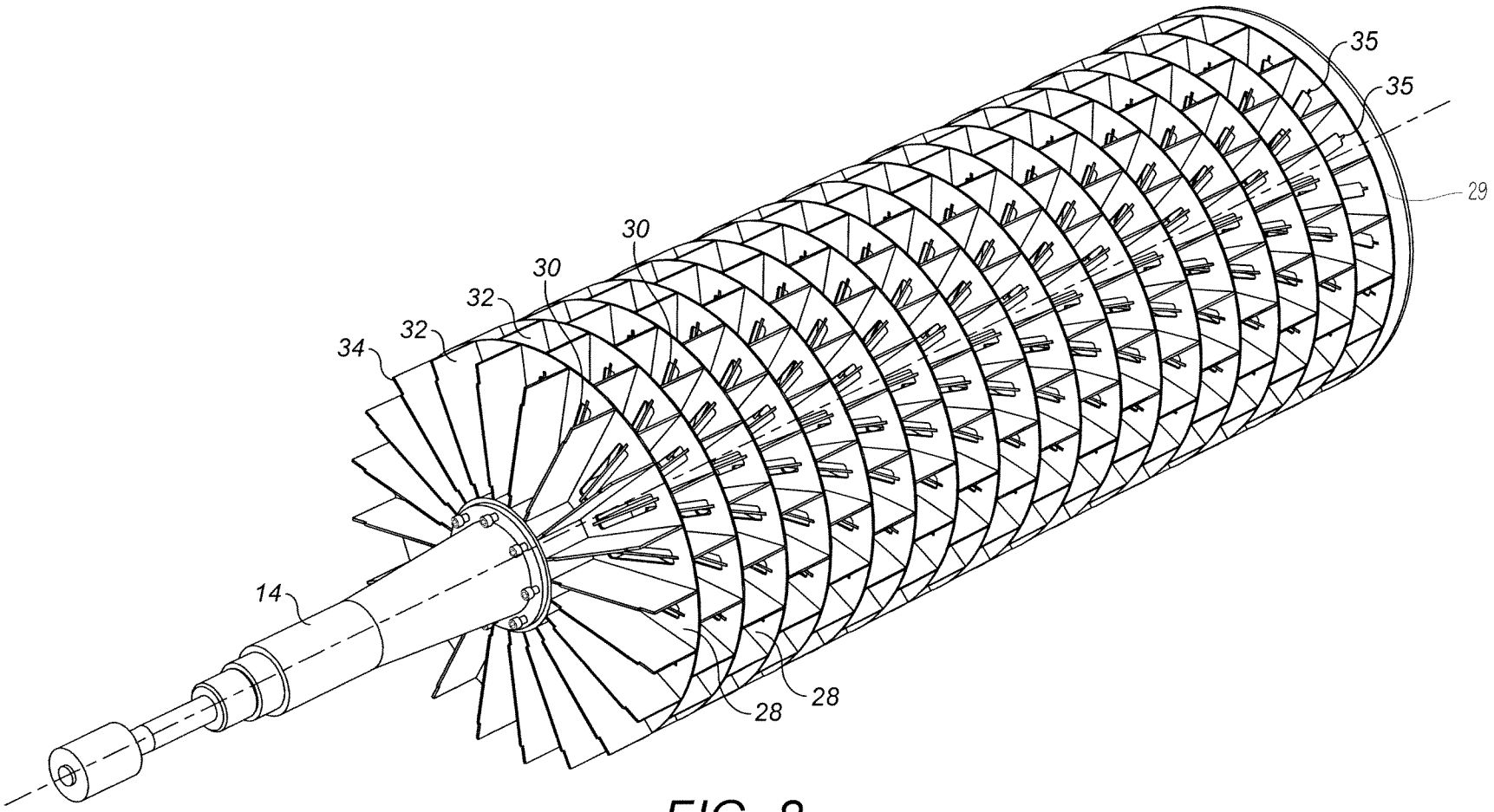
FIG. 8 is a perspective view of part of a shaft and vane section of the rotor shown in FIG. 2.
Figure 9:
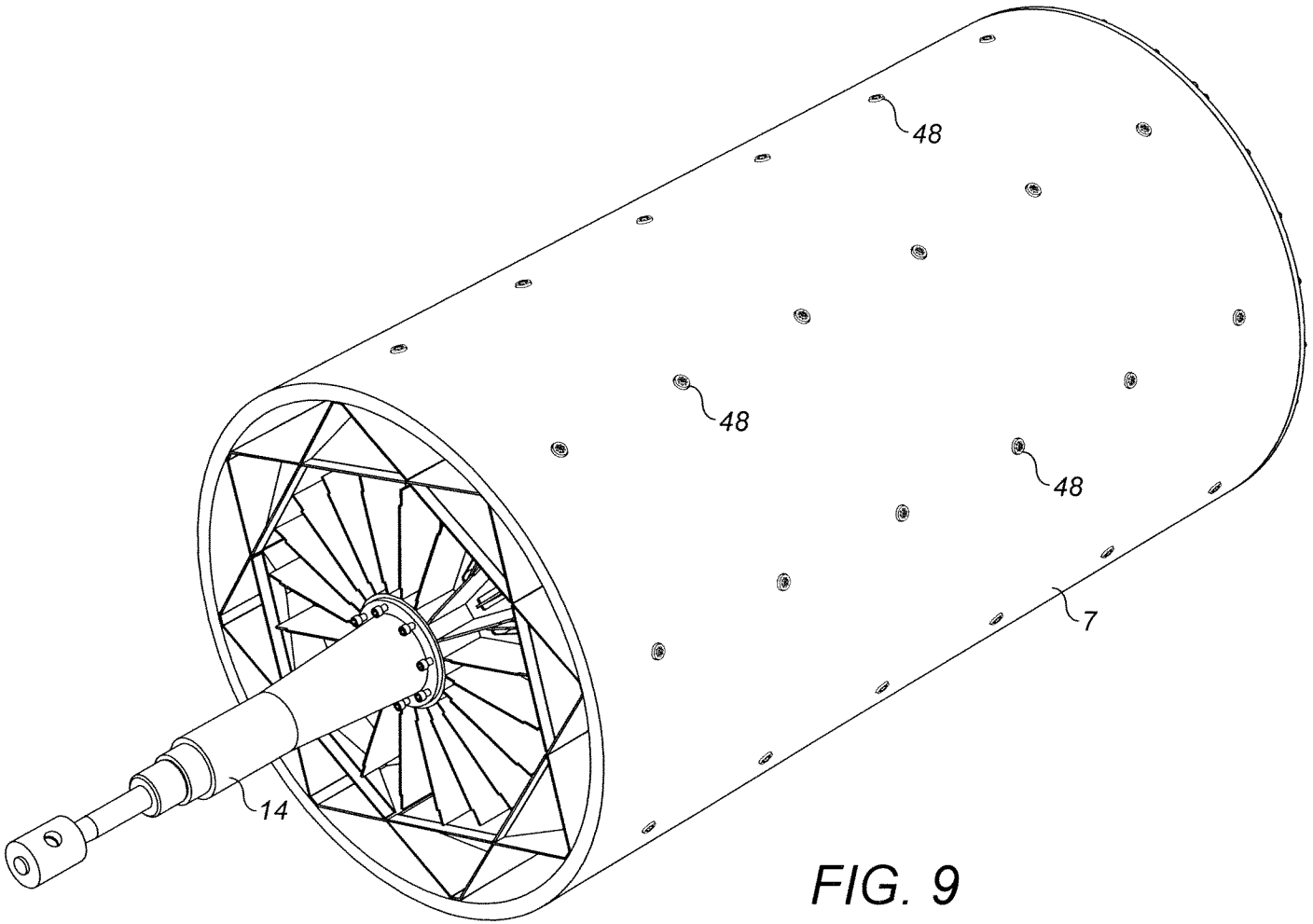
FIG. 9 is a further perspective view of part of a drum section of the rotor shown in FIG. 2.

As shown in FIGS. 2, 6 and 8, each disc 28 has a plurality of radially extending slots 30 spaced equally about the separator axis 16. The embodiment shown has twenty slots 30 in each disc 28. The discs 28 are arranged such that the slots 30 of adjacent discs 28 are angularly offset about the axis 16 with respect to each other and so that the slots 30 of alternating discs 28 are angularly aligned. Fins 32 are disposed between, and adjoin, adjacent discs 28. The fins 32 extend both axially and radially. Each fin 32 is aligned with a respective slot 30 of a forward disc—i.e. a disc closer to the drum inlet 20—and bisects the slot 30 along its length. The slots 30 and fins 32 thus define a series of staggered and interconnected flow passages along the length of the drum 7. Each fin 32 has profiled edges 34 which fit with corresponding locating notches 35 provided in the discs 24 at the ends of the slots 30.

As shown in FIG. 2, an annular weir plate 29 is provided adjacent the first and third phase outlets 22. The radially inner periphery of the weir plate 29 is offset from the outer surface of the shaft 14. An annular plate 31 extends from the radially inner periphery of the weir plate 29 to the end wall of the drum 7 so as to define an annular flow passage between the weir plate 29 and the first phase outlet 22.

As shown in FIGS. 2, 5, 6 and 7, accumulators in the form of pyramid-shaped funnels 36 are arranged about the inside of the radially outer wall of the drum 7. The funnels 36 are disposed radially outwardly of the discs 28 and fins 32. Each funnel 36 converges in a radially outward direction towards a respective second phase outlet 24.

The funnels 36 are constructed from an arrangement comprising a corrugated plate 38 and a plurality of funnel plates 40. The corrugated plate 38 extends circumferentially within the outer wall of the drum 7 such that the corrugations 42 of the corrugated plate 38 extend parallel with the separator axis 16. The corrugated plate 38 shown in the embodiment has eight corrugations 42, and so has the shape, in cross-section as seen in FIG. 6, of an eight-pointed star. A funnel plate 40 is disposed along the length of each corrugation 42 on the radially inward side of the corrugated plate 38. Each funnel plate 40 is corrugated along its length and has six corrugations 44. The profiles of the funnel plates 40 correspond to the profile of the corrugations 42 along which they are disposed. The corrugated plate 38 and the funnel plates 40 cooperate to define forty-eight funnels 36 in total. Each funnel 36 has two opposite sides formed by opposite sides of one of the corrugations 42 of the corrugated plate, and two opposite sides formed by opposite sides of one of the corrugations 44 of the respective funnel plate 40. In the embodiment shown, the radially inner edges of each funnel 36 are conterminous with radially inner edges of adjacent funnels 36. This ensures that the funnel structure on the inside of the drum 7 provides inclined surfaces over a large proportion of the interior of the rotor 6.

Each funnel 36 has an aperture 46 at the convergence of the funnel 36 which aligns with a corresponding second phase outlet 24. A non-return valve 48 is disposed at each of the second phase outlets 24 to control flow through the respective outlets 24.

Figure 7:
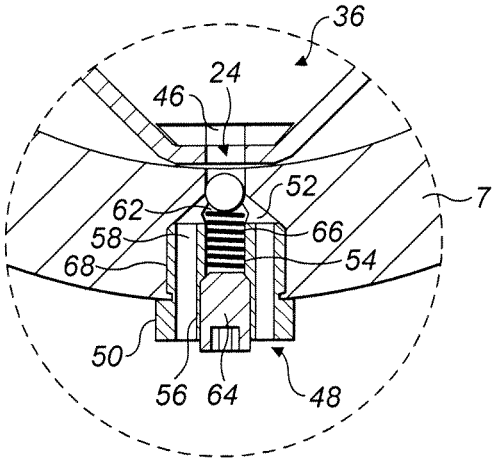
FIG. 7 is an enlarged partial sectional view of the region VI in FIG. 6.

FIG. 7 shows an enlarged sectional view of the vertex of one of the funnels 36 and the corresponding section of the cylindrical wall of the drum 7 in the region of a second phase outlet 24 and non-return valve 48. The non-return valve 48 comprises a cylindrical body 50 having a screw-threaded outer surface. The body 50 is screwed into a tapped hole 68 in the outer wall of the drum 7. The hole 68 has a convergent portion 52 which communicates with the second phase outlet 24. The body 50 has a central bore 54 which extends along its length. The bore 54 has a screw threaded portion 56 at the end opposite the convergent portion 52 of the hole 68. A plurality of flow passages 58 are arranged circumferentially about the central bore 54. The flow passages 58 extend along the length of the body 50 and provide fluid communication between the second phase outlet 24 and the outer region between the separator casing 4 and the drum 7. A spring 66 is accommodated within the bore 54 and abuts an adjustment screw 64. The spring 66 biases a ball 60 into the convergent portion 52 to close the second phase outlet 24.

When the valve 48 is closed, the ball 60 is seated on the periphery of the second phase outlet 24 and is held in contact with the periphery of the second phase outlet 24 by the spring 66. Displacement of the ball 60 against the action of the spring 66 creates a flow path from the second phase outlet 24 about the ball 60 and through the flow passages 58 thereby opening the valve 48.

Figure 4:
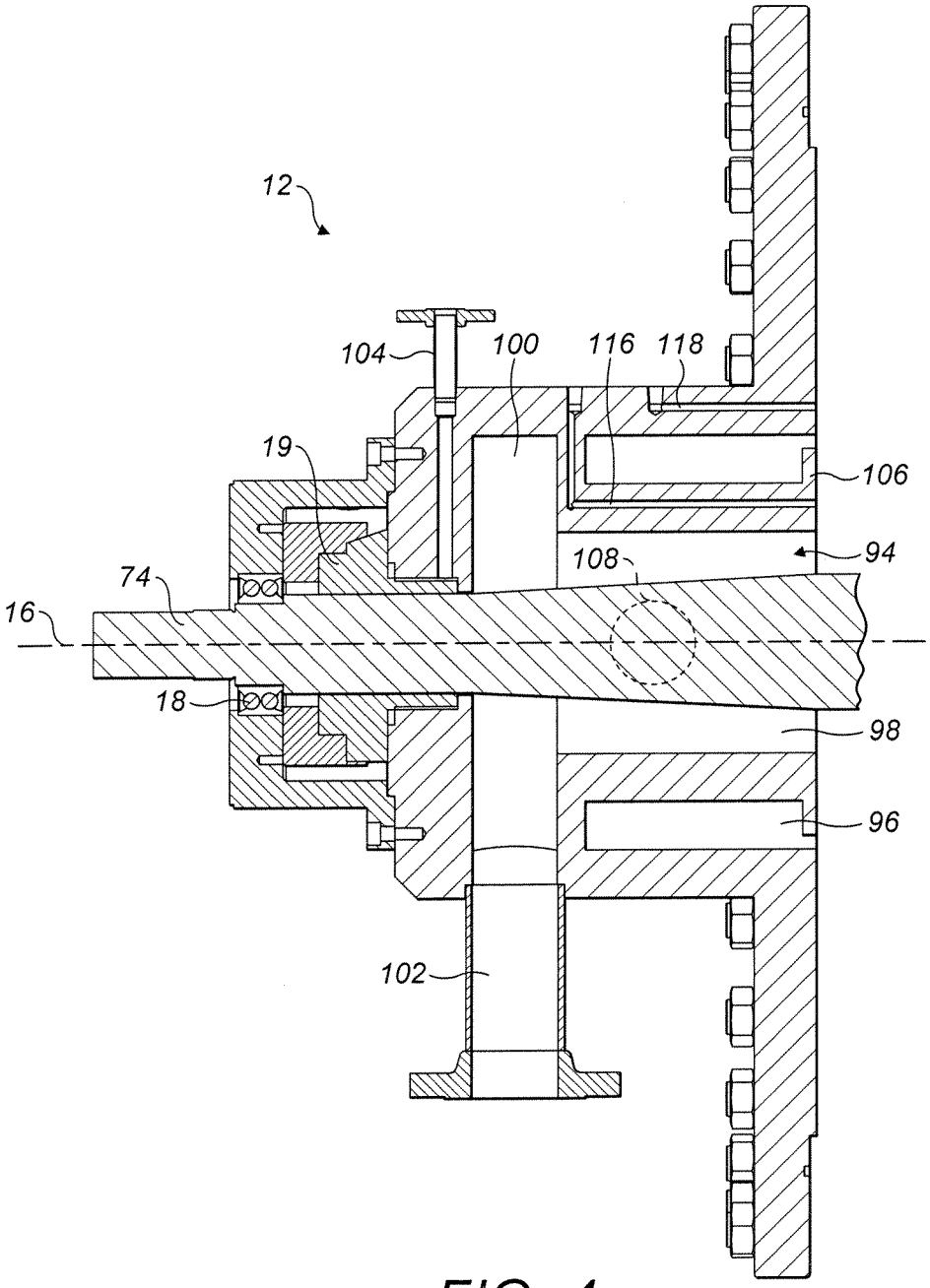
FIG. 4 is an enlarged sectional view of the end of the separator shown in FIG. 1 opposite the end shown in FIG. 3.
Figure 5:
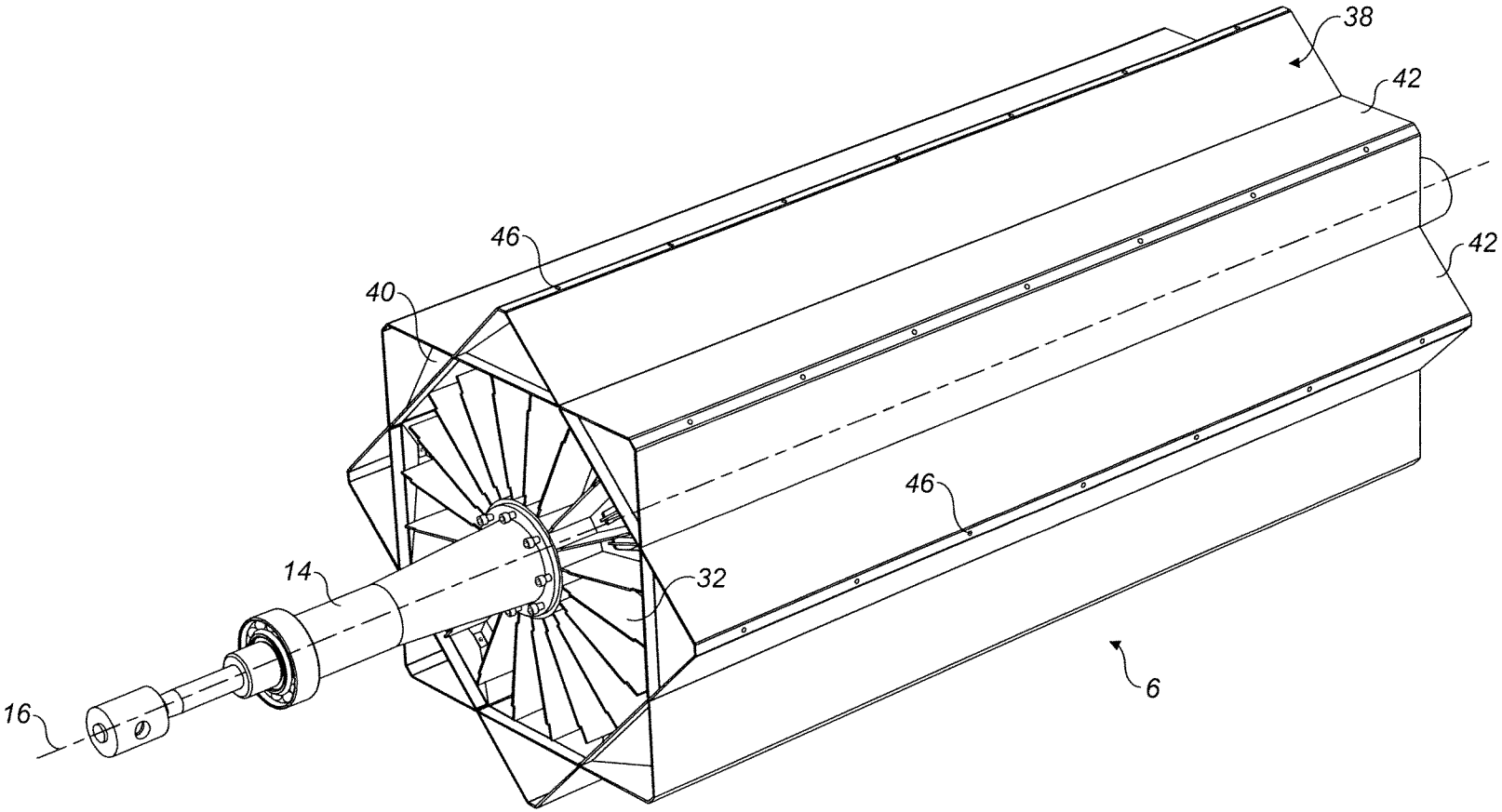
FIG. 5 is a cut-away perspective view of part of a rotor of the separator shown in FIG. 2.

Referring to FIGS. 2, 3 and 4, the shaft 14 comprises a tubular section 70 into which solid end sections 72, 74 are partially inserted at each end. The tubular section 70 thus defines an elongate cavity between the solid end sections 72, 74. The solid end sections 72, 74 are supported by the bearings 18. The bearings 18 are housed in respective chambers formed by end walls of the flanges 10, 12. Mechanical seals 19 seal the shaft 14 in the casing 4 and define separation zones between the mechanical seals 19 and the bearings 18 which prevent liquid contamination of the bearings 18. The mechanical seals 19 are double mechanical seals comprising a lubricant held at a higher pressure than the process pressure between the mechanical seals 19 to prevent solids ingression. The bearings 18 are open to the atmosphere to prevent pressurization of the bearings 18 during operation of the separator 2. A motor (not shown) is provided to drive the shaft 14.

Emulsion tubes 76 project in a radial direction from the solid end section 74 at the outlet flange 12 to a region which is radially outwards of the first phase outlet 22 and radially inwards of the outer periphery of the weir plate 29. The emulsion tubes 76 are in fluid communication with a discharge passage 78. The discharge passage 78 comprises a tube which extends axially along the length of the shaft 14 and exits through the solid end section 72 at the inlet flange 10.

The cylindrical section 8 of the casing 4 has flanges 80, 82 at each end which are welded to the casing and attached to the respective flanges 10, 12 by fasteners such as bolts or studs.

The outer casing 4 defines a chamber within which the drum 7 is disposed. A sump 84, formed in the wall of the cylindrical section 8, extends radially downwardly from the bottom of the separator 2. A solids outlet port 86 is provided at the bottom of the sump 84. A solids flow regulator (not shown) for regulating flow from the solids sump 84 through the solids outlet port 86 and a level control (not shown) for controlling the level of liquid in the sump 84 are also provided.

The inlet flange 10, shown in FIGS. 2 and 3, comprises an inlet chamber 88 disposed adjacent the drum inlet 20. The inlet chamber 88 is in fluid communication with the interior of the drum 7 through the drum inlet 20. A seal 90, for example a labyrinth seal, is disposed about the periphery of the drum inlet 20 between the inlet flange 10 and the drum 7, thereby sealing the inlet chamber 88 and the interior of the drum 7 from the chamber defined by the outer casing 4. The inlet chamber 88 has an inlet port 92 which is arranged tangentially with respect to the separator axis 16.

The outlet flange 12, shown in FIGS. 2 and 4, comprises a first phase outlet chamber 94 disposed adjacent the first phase outlet 22 and a third phase outlet chamber 96 disposed adjacent the third phase outlet 26. The drum 7 is in fluid communication with the first and second phase outlet chambers 94, 96 through the respective first and third phase outlets 22, 26.

The first phase outlet chamber 94 comprises a smaller diameter portion 98 adjacent the first phase outlet 22 and a larger diameter portion 100 spaced away from the first phase outlet 22 in an axial direction. A first phase outlet pipe 102 projects radially downward from the lower region of the larger diameter portion 100. The first phase outlet pipe 102 is perpendicular to the separator axis 16.

A gas outlet pipe 104 extends from a region axially adjacent the larger diameter portion 100 of the first phase outlet chamber 94 in an upward direction. A cartridge seal is disposed between the shaft 14 and the outlet flange 12 in the region of the gas outlet pipe 104. A flow path between the larger diameter portion 100 and the gas outlet pipe 104 is defined across the cartridge seal.

The third phase outlet chamber 96 is annular and surrounds the smaller diameter portion 98 of the first phase outlet chamber 94. A partition 106 is disposed at the third phase outlet 26 between the drum 7 and the third phase outlet chamber 96. The partition 106 is formed integrally with the radially inner wall of the third phase outlet chamber 96 and extends radially outwardly with respect to the separator axis 16. A third phase outlet pipe 108 (shown in FIG. 1 and in outline in FIG. 4) projects radially outwardly from the third phase outlet chamber 96. The third phase outlet pipe 108 is perpendicular to the separator axis 16 and the first phase outlet pipe 102.

An annular first seal 110 is disposed between the drum 7 and the outlet flange 12 about the periphery of the first phase outlet 22 thereby sealing the first phase outlet chamber 94 from the chamber defined by the outer casing 4 and also from the third phase outlet chamber 96. A second seal 112 is disposed between the drum 7 and the outlet flange 12 about the outer periphery of the third phase outlet 26. The second seal 112 is also annular and is coaxial with, and disposed radially outwardly of, the first seal 110. The second seal 112 thus seals the third phase outlet chamber 96 from the chamber defined by the outer casing 4. The seals 110, 112 allow rotation of the drum 7 with respect to the flanges 10, 12. In the present embodiment the seals 110, 112 are labyrinth seals.

Ducts 114, 116 and 118 are formed within walls of the inlet flange 10 and the outlet flange 12 to supply sealing fluid to the respective labyrinth seals 90, 110 and 112. The sealing fluid may, for example, be pressurized oil, water or gas.

A pressure release valve (not shown) is provided in the outer casing 4.

Means (not shown) for independently controlling the back pressure at the first phase outlet 22 and the third phase outlet 26 are provided. This may, for example, be flow regulators.

In use, an influent mixture comprising two immiscible liquids, such as oil and water, a solid particulate, such as sand, and a gas is supplied through the inlet port 92 into the inlet chamber 88. The tangential arrangement of the inlet port 92 promotes circulation of the influent within the inlet chamber 88 before flowing through the drum inlet 20 into the drum 7 which is rotated at high speed by the motor driving the shaft 14. The rotor 6 may, for example, be driven at speeds which are not less than 1750 rpm and not more than 10000 rpm. The centrifugal force exerted on the influent mixture may be at least 1000 g.

The influent mixture flows from the drum inlet 20 towards the first and third phase outlets 22, 26 by passing through the slots 30 in the discs 28. As the mixture progresses along the drum 7, the rotating discs 28 exert shear forces (e.g. laminar drag) on the mixture which accelerate and maintain rotation of the flow. The fins 32 assist with promoting and maintaining rotation of the mixture in synchronization with rotation of the rotor 6. High-speed rotation of the mixture generates a centrifugal force which causes the denser components, i.e. the water and the sand, to migrate radially outwardly which, in turn, displaces the oil and gas radially inwardly. Thus, as the mixture progresses along the drum 7 it separates into stratified layers of the individual components or phases. The staggered flow passages 30 inhibit flow from the drum inlet 20 directly to the first and third phase outlets 22, 26. Inhibiting the flow increases the residence time of the mixture in the drum 7 so that the oil and water of the original mixture are substantially separated upon arrival at the first and third phase outlets 22, 26. An interface between the water and oil is therefore formed. The radial position of the interface can, for example, be controlled by varying flow rates through the first and third phase outlets 22, 26, although it will be appreciated that alternative methods are possible.

The water flows over the outer periphery of the weir plate 29 towards the third phase outlet 26. The position of the interface is controlled so that it remains radially outward of the first phase outlet 22 and radially inward of the outer periphery of the weir plate 29. This ensures that the separated oil is prevented from exiting through the third phase outlet 26 and instead flows along the passage defined by the annular plate 31 towards the first phase outlet 22. An emulsion, or rag layer, forms at the interface of the oil and water and/or the interface of the water and solids.

The centrifugal forces cause the solid particulates to "settle" within the flow which, in effect, causes them to migrate radially outwardly towards the funnels 36.

The separation process comprises two stages: an accumulation stage and a discharge stage. During the accumulation stage the pressure in the outer casing 4 is increased to a pressure which may be at least equal to the pressure inside the rotating drum 7. The pressure across the second phase outlets 24 during the accumulation stage is a positive pressure difference. The pressure in the outer casing, supplemented by the spring loading of the non-return valves 48, is sufficient to keep the non-return valves 48 closed against the pressure exerted by the rotating fluid on the internal surface of the drum 7. The pressure within the outer casing 4 is generated by introducing a fluid, preferably a gas such as nitrogen, to the outer casing 4. The pressure in the outer casing 4 may, for example, be held at 220 psi (approximately 1500 kPa). The introduced gas has a low viscosity with respect to the influent mixture. By surrounding the drum 7 with a low viscosity fluid, the drag acting on the drum 7 during the accumulation stage can be reduced. Furthermore, the effects of boundary layers, eddy flows and frictional forces are also decreased. The torque, and hence power, required to rotate the rotor 6 is reduced, thus improving operating efficiency. Pressurization of the outer casing 4 generates an external pressure on the drum 7, and hence a radially inwardly acting force on the outer wall of the drum 7. The radially inwardly acting force partially balances the centrifugal force acting on the drum 7 and thus reduces radial loading on the drum 7 for a particular operating speed of the rotor 6. The rotor 6 can therefore be operated at speeds which are greater than would otherwise be possible owing to structural limitations of the material of the rotor 6. The elevated speeds enhance separation of the mixture, for example, by reducing the separation time or improving the quality of the separated phases.

During the accumulation stage, oil and water are discharged from the drum 7 through the first and third phase outlets 22, 26 respectively into the first and third phase outlet chambers 84, 86. Oil exits the separator 2 through the first phase outlet pipe 102. Water exits the separator 2 through the third phase outlet pipe 108. Solid particulates entrained by the flow move radially outwardly and accumulate as a slurry or caked solid within the funnels 36. The inclined surfaces provided by the funnels 36 inhibit solids build-up in regions other than the convergences of the funnels 36.

The discharge stage begins once a desired quantity of solid particulates has accumulated in the funnels 36, or a set period of time has elapsed. One or both of the first phase and third phase outlets 22, 26 is/are restricted or closed and the pressurization of the outer casing 4 is maintained. This generates a back pressure within the drum 7. The back pressure is increased until it exceeds the pressure in the outer casing 4 and is sufficient to overcome the spring bias of the non-return valves 48 to force the valves 48 open. Alternatively, the valves may be forced open by introducing a higher pressure gas into the drum 7. At this point the pressure across the second phase outlets 24 is a negative pressure difference. The increased back pressure expels the accumulated solids from the drum 7 through the second phase outlets 24 into the region between the rotor 6 and the outer casing 4. It will be appreciated that the solids may be flushed through the second phase outlets 24 by discharging a proportion of the water in the radially outward region of the drum 7 with the solids. The expelled solids collect in the sump 84 from where they are discharged through the solids outlet port 86 either continuously under the control of the solids flow regulator, or in batches. A minimum liquid level is maintained in the sump 84 to provide a plug to maintain pressure in the casing 4 and to prevent gas blow-by.

The emulsion layer which forms at the interface of the oil and water is continuously, or periodically, extracted through the emulsion tubes 76 and discharged from the separator 2 through the discharge passage 78. The radial position of the emulsion layer may be controlled by varying the pressures at the first and third phase outlets 22, 26. For example, an increase in the back-pressure at the first phase outlet 22 would create a build up in the quantity/depth of oil retained in the drum 7 with respect to the quantity of water, thus displacing the emulsion layer radially outwardly. Control of the emulsion layer may be carried out with a timer on a programmable logic controller.

Figure 16:
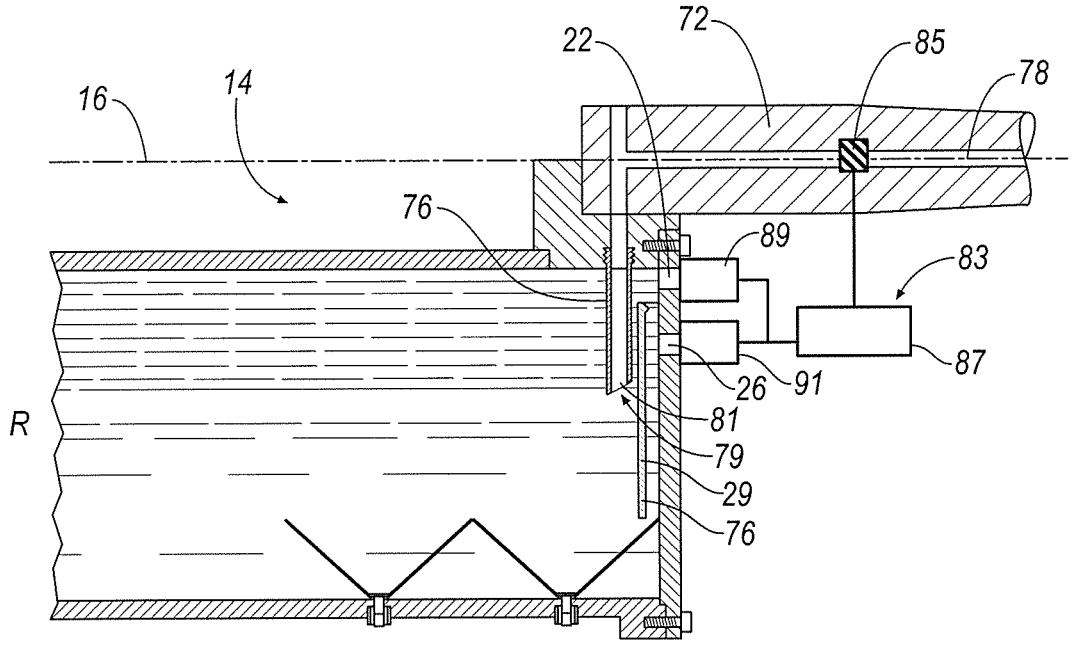
FIG. 16 is a schematic representation of a variant of part of a separator such as that shown in FIG. 1 or 11.
Figure 17:
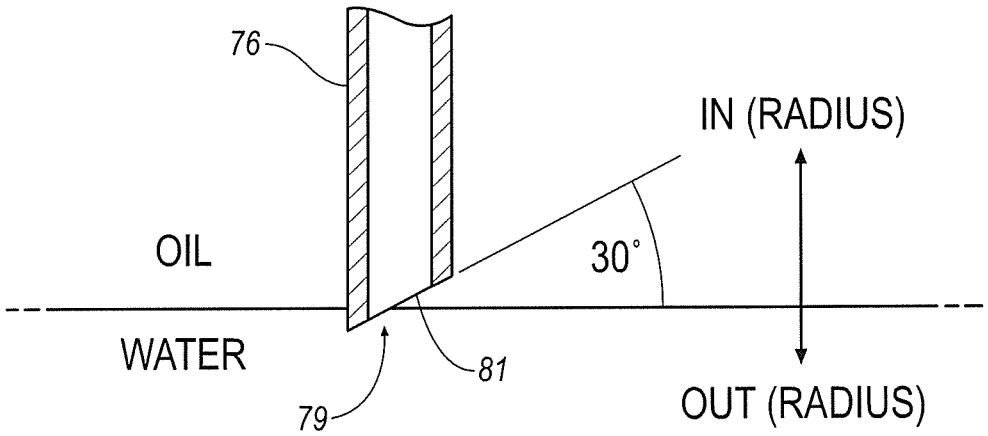
FIG. 17 is a schematic representation of part of a tube in which an outlet port is provided.

In the variant shown in FIG. 16, at least one of the emulsion tubes 76 positioned adjacent the weir plate 29 has a tip 79 in which an emulsion outlet in the form of a sample port 81 is provided. In the embodiment shown, a plane of the sample port 81 is inclined with respect to the separator axis 16 such that the sample port 81 extends over a small distance in the radial direction of the separator 2. As shown in FIG. 17, the angle of inclination of the plane of the sample port 81 with respect to the axial direction of the separator 2 is 30 degrees. However, it will be appreciated that the angle of inclination can be at least 20 degrees, and may for example be between 20 and 70 degrees.

The emulsion tube 76 is arranged such that the sample port 81 is disposed at a reference position R. The reference position R is a predetermined distance from the first phase outlet 22 in the radial direction with respect to the separator axis 16, and is radially inward of the outer periphery of the weir plate 29. In the embodiment shown, the reference position R is midway between the first phase outlet 22 and the outer periphery of the weir plate 29.

The emulsion tube 76 is in fluid communication with a discharge passage 78. The discharge passage 78 comprises a tube which extends axially through a solid end section 72 at the end of the shaft 14. A control system 83 for controlling the radial position of the interface in accordance with the amount of oil and/or water contained in fluid discharged through the emulsion tube 76. In the embodiment shown, the control system comprises a density meter 85, such as a coriolis meter (shown only schematically in FIG. 16). The density meter 85 is arranged to measure the density or specific gravity of the emulsion discharged through the emulsion tube 76. The control system further comprises an interface controller 87. The output of the density meter 85 is in communication with the interface controller 87. The interface controller 87 is connected to means, which in the embodiment shown comprises flow regulators 89, 91, for controlling the back pressure at the first phase outlet 22 and the third phase outlet 26 independently of each other. The interface controller 87 is configured to control the flow regulators 89, 91 such that flow, and hence back pressure, at the first phase outlet 22 and second phase outlet 26 can be increased or decreased independently of each other.

The position of the interface is controlled by applying back pressures using the flow regulators 89, 91 to the first and third phase outlets 22, 26. Increasing the back pressure applied to the third phase outlet 26 with respect to the first phase outlet 22 increases the volume of water retained in the drum 7 which increases the radial depth of water with respect to the outer wall of the drum 7. Consequently, the interface is displaced radially inwardly. Conversely, decreasing the back pressure applied to the third phase outlet 26 with respect to the first phase outlet 22 decreases the volume of water retained in the drum 7 and so displaces the interface radially outwardly.

It will be appreciated that the back pressure applied to the first phase outlet 22 could be varied instead of, or in addition to, the back pressure applied to the third phase outlet 26 to achieve the same effect of displacing the interface radially.

In normal use, it is desirable to maintain the radial position of the interface at the reference position R so that the interface remains radially outward of the first phase outlet 22 and radially inward of the outer periphery of the weir plate 29. This ensures that the separated oil is prevented from exiting through the third phase outlet 26 and the separated water is prevented from exiting through the first phase outlet 22. Furthermore, positioning the interface midway between the first phase outlet 22 and the outer periphery of the weir plate 29 provides equal treatment time for de-oiling of the water and dehydration of the oil.

An emulsion, or rag layer, forms at the interface of the oil and water. The emulsion layer is expelled through the emulsion tubes 76 by applying a back pressure to both the first and third phase outlets 22, 26. The back pressure may, for example, be 15 psi (100 kPa). The density of the emulsion layer expelled through the emulsion tubes 76 is measured by the density meter. The density of the emulsion layer is dependent on the relative amounts of oil and water present in the emulsion. For example, an emulsion having a larger volume of water than oil will have a greater density than an emulsion having a lower volume of water than oil.

The measured density of the emulsion layer is compared against a reference density. The reference density is a predicted or known density of a water and oil mixture at the interface, for example an expected density of the emulsion layer. The reference density may, for example, be a density which would normally be associated with a mixture of not more than 60% and not less than 40% oil, and not more than 60% and not less than 40% water. For example, the reference density may correspond to a mixture comprising 50% oil and 50% water, or a mixture of oil and water together with other impurities. If the measured density is greater than the reference density, this indicates that the proportion of water in the emulsion is too high and that the interface is radially inward of the reference position R. The interface is returned to the reference position R by increasing the back pressure at the first phase outlet 22, for example by decreasing the amount of flow through the first phase outlet, and/or decreasing the back pressure applied to the third phase outlet 26, for example by increasing the amount of flow through the third phase outlet. This causes the volume of the oil retained in the drum 7 to increase and the volume of the water retained in the drum to decrease thereby moving the interface radially outwardly.

It will be appreciated that the size and/or inclination of the sample port 81 could be adapted to increase or decrease the radial extent over which the emulsion layer at the interface is sampled. Increasing the radial extent over which the emulsion layer is sampled would reduce the sensitivity of the monitoring system to small fluctuations in the content of the emulsion layer.

Alternatively, the sample port 81 may be provided separately of the emulsion tubes 76 for example in a wall of the drum 7, or, where emulsion tubes are not part of the separator 2, in a separate sampling tube. It will be appreciated that where a weir plate is not provided, the sample port can be disposed between the first and third phase outlets with respect to the radial direction.

The location of the reference position R at which the sample port 81 is disposed can be specified to favor de-oiling of the water or dehydration of the oil. For example, if it is preferable to obtain water having a particularly low oil content, the reference position R, at which the interface is maintained, is positioned closer to the first phase outlet 22 than the outer peripheral edge of the weir plate 29. Consequently, during operation of the separator 2, the radial depth of water in the drum 7 is greater than it would be if the interface were maintained at a reference position R midway between the first phase outlet 22 and the outer edge of the weir plate 29. This increases the retention time of the water in the separator 2 which improves the separation of the oil from the water. This may be particularly advantageous for the removal of heavy oils which form small drops that are particularly difficult to remove from water.

Conversely, if the reference position R at which the sample port 81 is disposed is positioned closer to the outer edge of the weir plate 29 than the first phase outlet 22, the volume, and hence radial extent, of oil within the drum 7 will be such that dehydration of the oil is favored.

In a variant of the separator 2, the position of the sample port 81 can be changed, for example by replacing the emulsion tube 76 comprising the sample port 81 with an emulsion tube having a different length. Alternatively, the emulsion tube 76 comprising the sample port 81 could be adjustable such that the radial position of the sample port 81 can be varied during operation of the separator 2.

An emulsion layer may form at the interface of the water and sand. The emulsion layer comprises very fine particles (e.g. particles of sand) covered by a thick film of oil and a further film of water such that the coated particle has neutral buoyancy in water and so resides at the interface of the water and sand. Build up of the emulsion layer may be identified by a change in differential pressure or change in the balance of the rotor 6. This emulsion layer may be expelled through the second phase outlets 24 during the discharge phase.

Gas collects in the larger diameter portion 100 of the first phase outlet chamber 94, in the region adjacent the shaft 14. The gas flows around the cartridge seal and exits the flange 12 through the gas outlet pipe 104. This ensures that the separator 2 is degassed at all times.

It will be appreciated that opening of the valves 48 and expulsion of solids from the drum 7 could also be achieved by decreasing pressure in the outer casing 4 or altering the bias acting on the balls 60 in the valves 48 during operation, or by increasing the rotational speed of the drum 7. Combinations of these may also be used. Other suitable means for opening the valves could also be used.

It will be appreciated that the positive pressure difference generated during the accumulation stage can refer to embodiments in which a pressure difference in which the region between the casing 4 and the drum 7 is equal to or less than the pressure in the drum 7, provided that the valve bias is sufficient to close the valve 48.

The pressure in the outer casing 4 may, during the accumulation stage, be held at not less than 150 psi (approximately 1000 kPa), and not more than 600 psi. Embodiments in which the pressure in the outer casing 4 is held respectively at 150 psi (approximately 1000 kPa), 300 psi (approximately 2000 kPa) and 600 psi (approximately 4100 kPa) are possible.

The rate of flow through the separator 2 may be not less than 100 US gallons per minute (approximately 18.9 liters per second) and not more than 1000 US gallons per minute (63.1 liters per second).

During use, the fluid in the outer casing 4 may be held at an elevated temperature. For example, the fluid may be hotter than the influent mixture.

Although the discs 28 are shown to be flat circular discs, it will be appreciated that they could be a different shape, for example cone shaped. The flow passages may, for example, be formed by perforations in the discs 28.

The first and third phase outlet pipes 102, 108 can be arranged tangentially with respect to the separator axis 16.

It will be appreciated that a single set of circumferentially arranged funnels 36 could be used.

Figure 10:
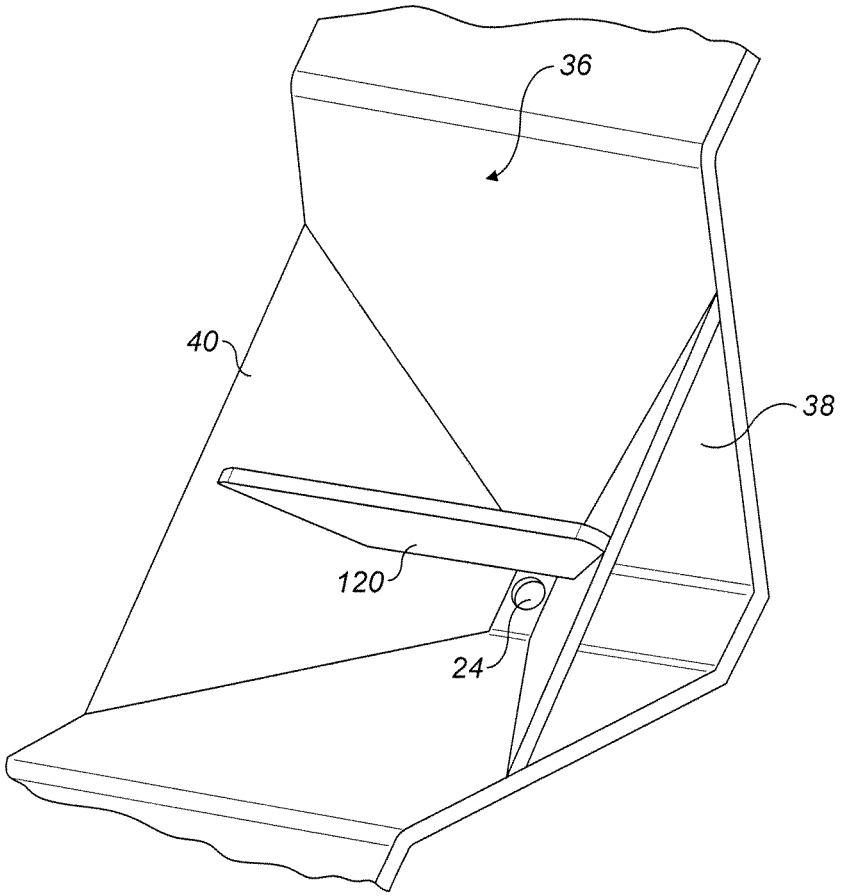
FIG. 10 is a partial perspective view of the rotor according to a variant of the invention in the region of an accumulator.

FIG. 10 shows an embodiment in which a baffle 120 extends across a mid-portion of each funnel 36 in a direction which is parallel with the separator axis 16. The baffle 120 has a radially inner edge which is adjacent the divergent end of the respective funnel 36 and a radially outer edge which is spaced away from the second phase outlet 24.

A variant of the present invention comprises a rotor having high pressure spray nozzles arranged along the shaft which are oriented to spray cleaning fluid radially outwardly towards the funnels. The spray nozzles are in communication with the emulsion discharge passage. When the separator is not in operation, or following the discharge stage, a washing fluid can be supplied through the discharge passage and sprayed through the nozzles against the inside of the funnels to clean the funnels. An alternative function of the spray nozzles is to introduce a solution to dilute the influent mixture within the drum during the separation process, or to break-up compacted solids and to slurry the solids before discharge.

A further embodiment of the invention is shown in FIGS. 11 to 16. The main differences with respect to the embodiment shown in FIGS. 1 to 10 are described.

The discs 28 are spaced axially so that two adjacent discs 28, and corresponding fins 32, are disposed adjacent each funnel 36.

Each disc 28 has notches 122 along the inner peripheral edge of the disc 28 adjacent the shaft 14. Each notch 122 defines an aperture 124 with the radially outer surface of the shaft 14. In use, gas which has migrated to the region adjacent the shaft 14 flows through the apertures 124 towards the first phase outlet 22.

Spray nozzles 126, for example high pressure spray nozzles, extend radially outwardly from the shaft 14. The spray nozzles 126 are spaced axially and circumferentially along the shaft 14. The number of spray nozzles 126 is equal to the number of funnels 36, and the spray nozzles 126 are arranged such that each spray nozzle 126 extends towards the convergence of a respective funnel 36 and corresponding second phase outlet 24.

The spray nozzles 126 are in communication with the interior of the tubular section 70 of the shaft 14. A bore 128 is provided in each solid end section 72, 74 of the shaft 14. The respective bores 128 extend along the separator axis 16 and exhaust through opposite ends of the shaft 14. In the regions in which the tubular section 70 overlaps the solid end sections 72, 74, the spray nozzles 126 are in direct communication with the bores 128 via passages provided in the solid end sections 72, 74, which extend perpendicularly to the bores 128.

In use, a high pressure fluid can be supplied through the spray nozzles 126. The fluid is used to perform two functions: cleaning of the funnels 36 and the region surrounding the second phase outlets 24, and fluidizing of compacted solids to create a slurry prior to expulsion of the solids through the second phase outlets 24. When the solids content in the flow is low, the separator may be run for a longer period of time between expulsion stages to allow the solids to accumulate. However, the accumulated solids are more likely to become compacted against the inner surface of the funnel 36 by the centrifugal forces. Compacted solids can reduce the effectiveness of the expulsion stage. Therefore, fluidization of the solids prior to expulsion improves the efficiency of the expulsion process.

The number of fins 32 exceeds the number of spray nozzles 126. In the present embodiment, there are twelve fins 32 and eight spray nozzles 126. The fins 32 and the nozzles 126 are arranged so that they are angularly offset from each other about the separator axis 16.

Figure 11:
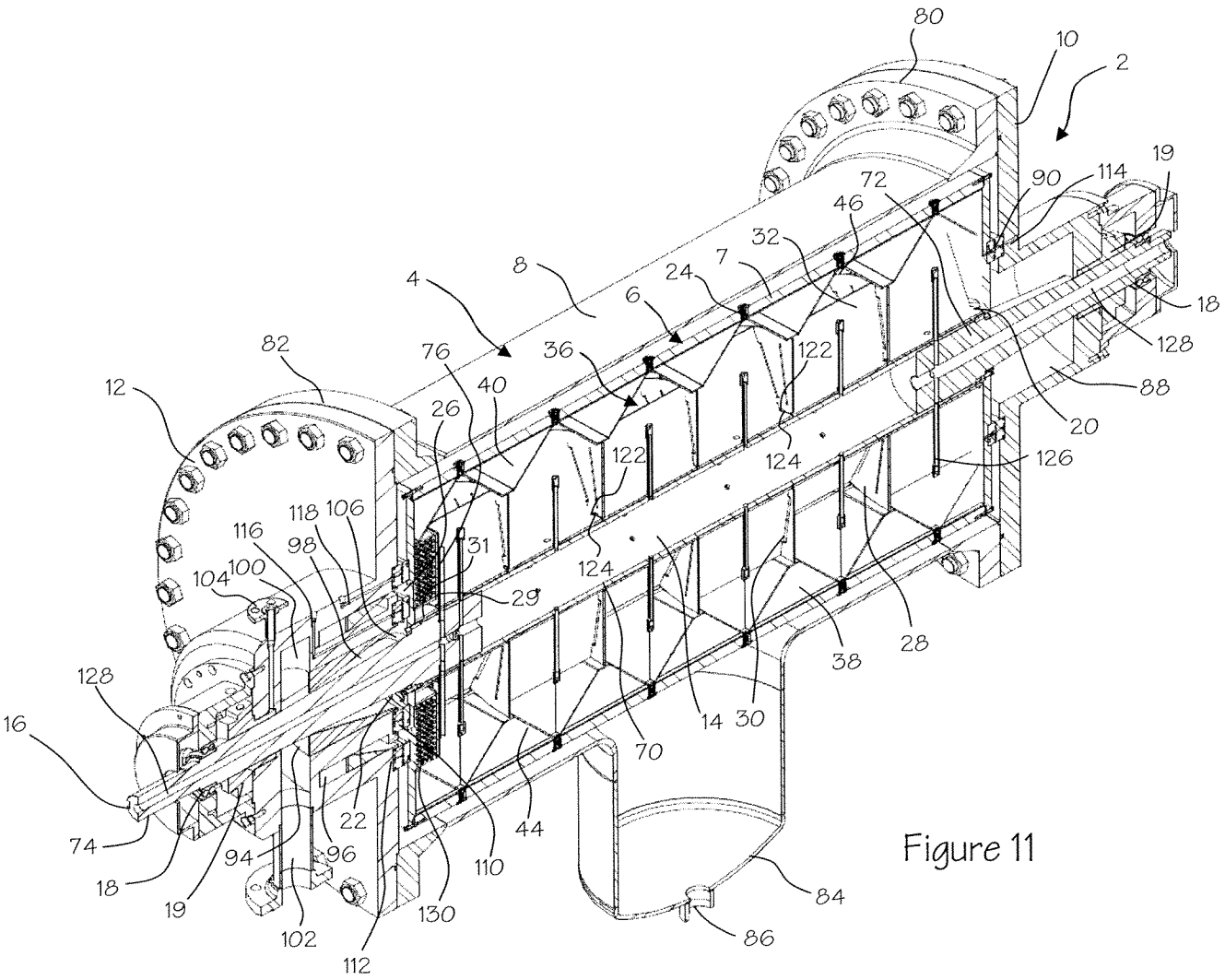
FIG. 11 is a perspective sectional view of a further embodiment of the separator.
Figure 12:
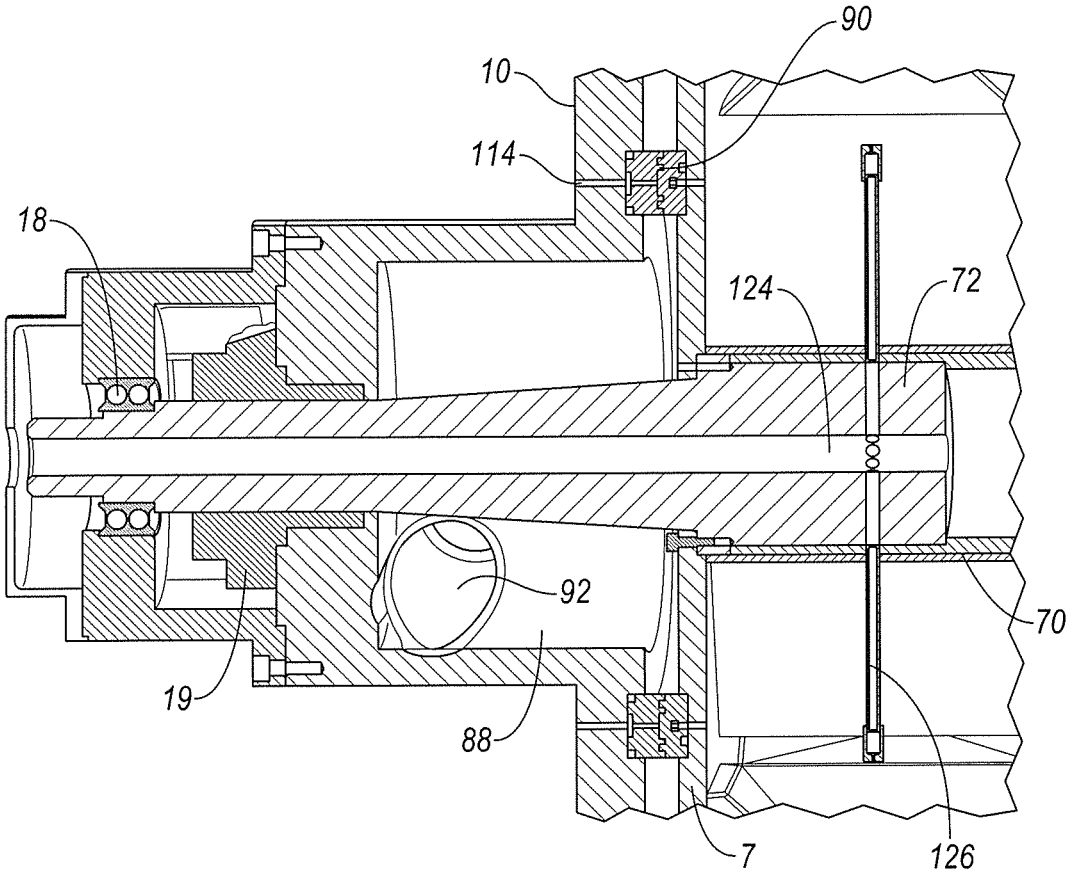
FIG. 12 is an enlarged perspective sectional view of an end of the separator shown in FIG. 11.
Figure 15:
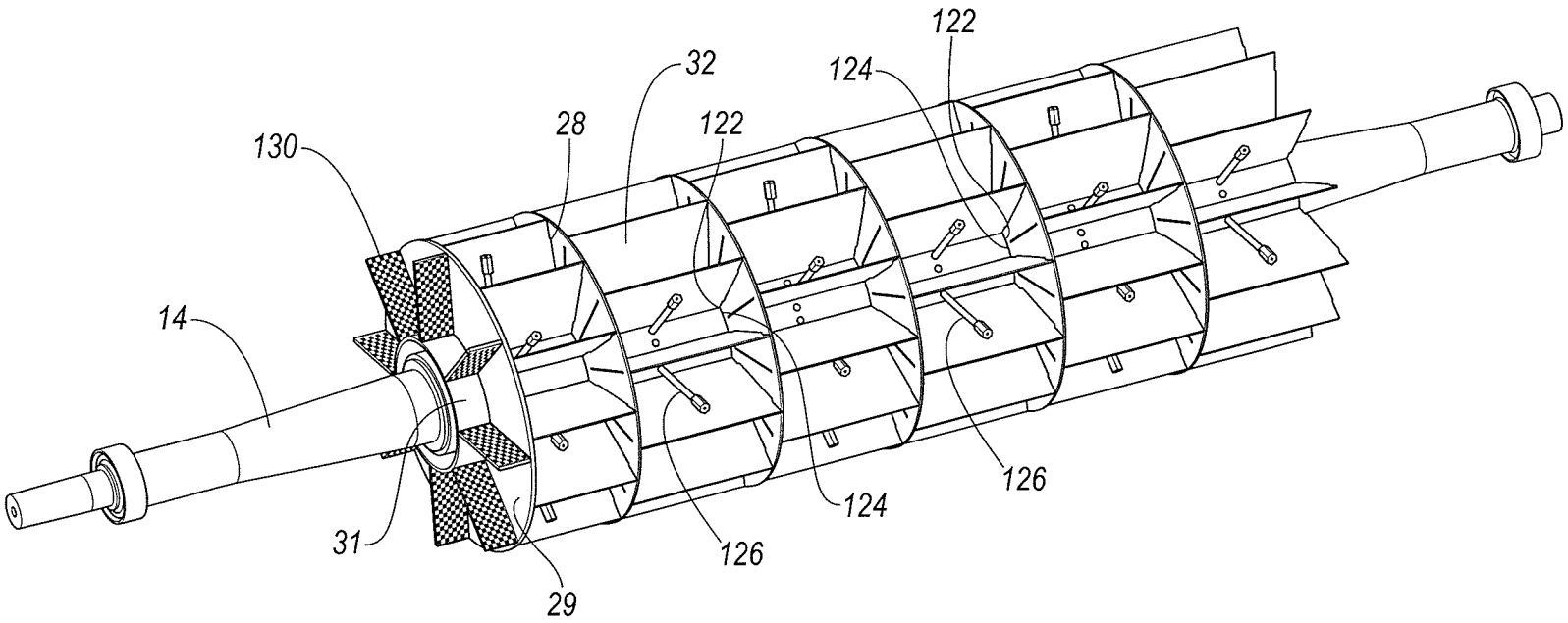
FIG. 15 is a perspective view of part of a shaft and vane section of the rotor shown in FIG. 11.

As shown in FIGS. 11 and 15, auxiliary vanes 130 are disposed between the weir plate 29 and the end wall of the drum 7. The auxiliary vanes 130 are secured to the weir plate 29 for rotation therewith. The auxiliary vanes 130 extend radially outwardly from the annular plate 31 to the outer periphery of the weir plate 29. Each auxiliary vane 130 is perforated. In use, the auxiliary vanes 130 maintain rotation of the flow and so inhibit vortex flow in the region between the weir plate 29 and the third phase outlet 26. The perforations in the auxiliary vanes 130 allow water to pass through the auxiliary vanes 130 during operation of the separator 2, and so ensure that the water levels, measured with respect to the axis 16 in the radial direction of the separator 2, in the regions between the auxiliary vanes 130 remain equal. Rotor imbalance resulting from uneven distribution of water about the rotor shaft 14, particularly during start-up and shut-down of the separator 2, is therefore prevented.

Figure 13:
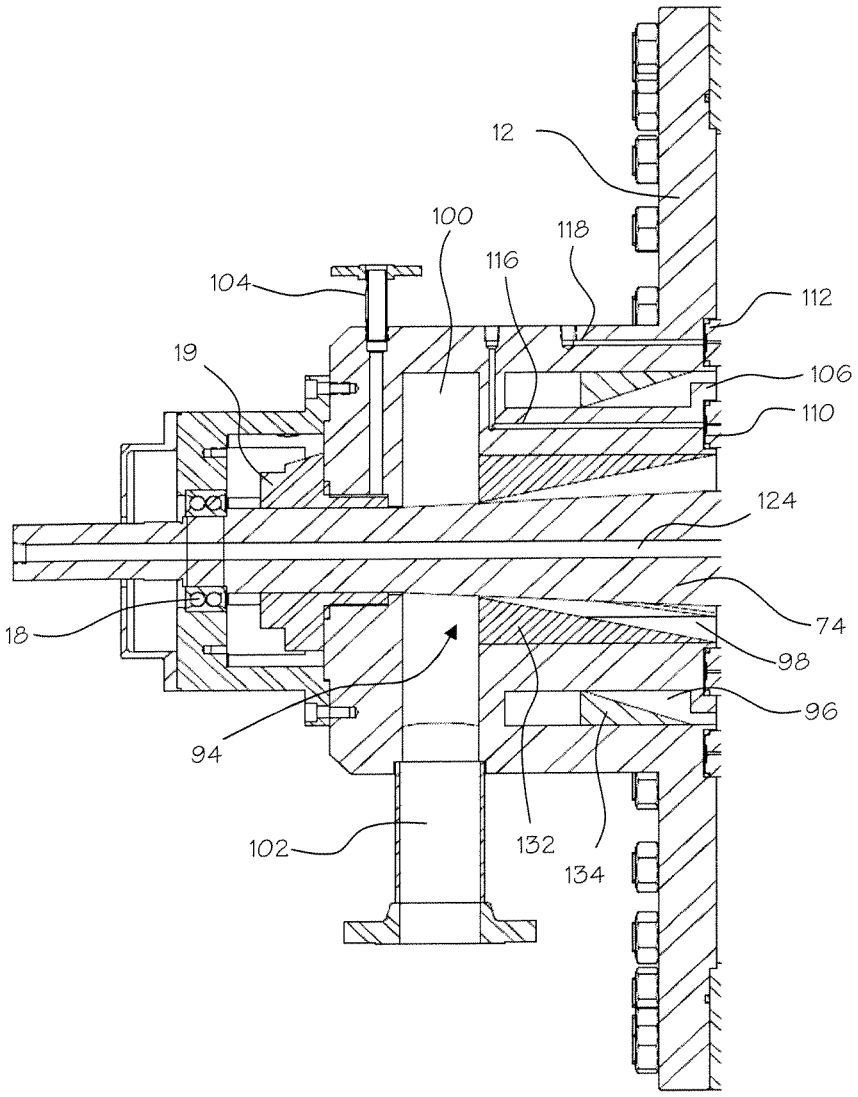
FIG. 13 is an enlarged sectional view of the end of the separator shown in FIG. 11 opposite the end shown in FIG. 12.
Figure 14:
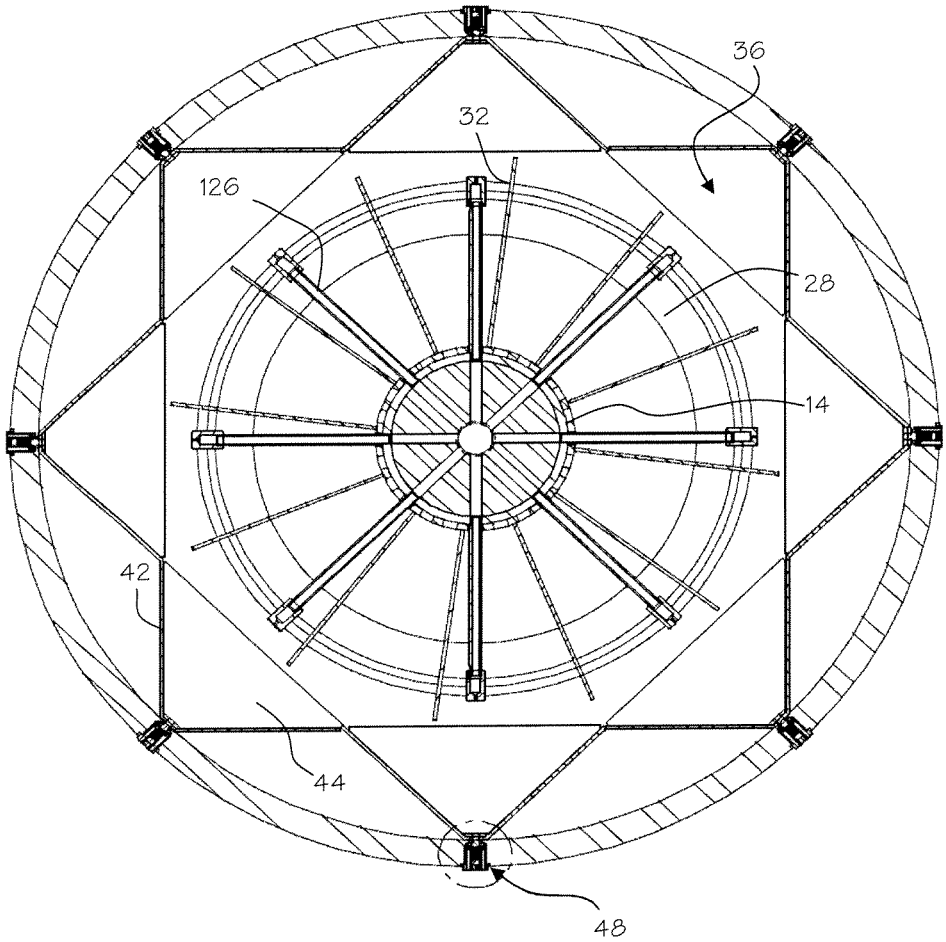
FIG. 14 is a radial sectional view of the part of the rotor shown in FIG. 11.

Referring to FIG. 13, the smaller diameter portion 98 of the first phase outlet chamber 94 is provided with stator fins 132. The stator fins 132 extend in an axial direction along the radially outer inner surface of the smaller diameter portion 98. The height of each stator fin 132 increases in the direction away from the first phase outlet 22. The stator fins 132 are fixed with respect to the first phase outlet chamber 94.

The third phase outlet chamber 96 is provided with stator fins 134. The stator fins 134 extend in an axial direction along the radially outer surface of the third phase outlet chamber 96. The stator fins 134 extend from the third phase outlet 26 to midway along the third phase outlet chamber 96. The stator fins 134 are tapered along their length and are arranged so that their height, with respect to the outer surface of the third phase outlet chamber 96, increases in the direction away from the third phase outlet 26. The stator fins 134 are fixed with respect to the third phase outlet chamber 96.

In use, the stator fins 132, 134 arrest flow rotation within the respective outlet chambers 94, 96.

It will be appreciated that the spray nozzles 122 may be fitted, or retrofitted, to the separator described with reference to FIGS. 1 to 10.

The respective arrangements of the notches 122 in the discs 28, fin 32 spacing, auxiliary vanes 130 and/or tapered fins 132/134 described with respect to the second embodiment could be incorporated separately, or as combinations thereof, into the other embodiments and variants described.

A further embodiment of the separator is used to separate algae in an effluent or backwash treatment process. With such an embodiment, the influent will be a two phase mixture comprising algae entrained by a liquid. The separator in this embodiment will not necessarily require a third phase outlet.

In use, the algae accumulates in the funnels either as a solid or as a concentrate. A centrifugal force may be generated which is sufficient to 'burst' the algal cells as they are compressed against the inner surfaces of the funnels. The algae may, however, be burst before or after the separation process. The accumulated algae are expelled through the second phase outlet and the remaining fraction of the influent mixture is expelled through the first phase outlet. The flow rate may be controlled in response to the algae density. For example, a desired algae density could be 60 000 ppm, or, for example, 6% solids by volume.

Following separation or concentration, the algae may be transplanted for further processing, for example in the manufacture of biofuel.

We claim:

1. A separator for separating a multiphase mixture comprising:

a pressure vessel, which defines a separator axis;

a support for supporting the pressure vessel for rotation about the separator axis;

at least one vane disposed within and coupled for rotation with the pressure vessel;

a flow regulator, wherein the pressure vessel has an inlet, a first phase outlet and a plurality of second phase outlets disposed radially outwardly of the first phase outlet with respect to the separator axis and the flow regulator is arranged to regulate flow through the second phase outlets; and a third phase outlet disposed radially outwardly of the first phase outlet and radially inwardly of the second phase outlets;

a control system which is arranged to control the radial position of an interface between first and third phases within the pressure vessel, wherein the control system comprises a regulator associated with least one of the first phase and the third phase outlets for varying pressure at said outlet, and a sample port for determining the proportion of first phase and/or second phase of a mixture of first and second phases at a predetermined reference position within the vessel, wherein the sample port extends in the radial direction with respect the separator axis such that the sample port extends over a predetermined radial extent, wherein a plane of the sample port is inclined with respect to the separator axis.

2. A separator according to claim 1, in which the flow regulator comprises a plurality of pressure-activated nozzles disposed respectively at the second phase outlets.

3. A separator according to claim 2, wherein each pressure-activated nozzle comprises a non-return valve for preventing flow into the pressure vessel.

4. A separator according to claim 3, in which the non-return valve comprises a bias which biases the non-return valve towards a closed position.

5. A separator according to claim 2, in which the pressure-activated nozzles are provided in a radially outer wall of the pressure vessel.

6. A separator according to claim 1, in which a plurality of accumulators is disposed within the pressure vessel adjacent respective ones of the second phase outlets.

7. A separator according to claim 6, in which the accumulators comprise funnels which converge in a radially outward direction towards the respective second phase outlets.

8. A separator according to claim 1, further comprising a pressure regulator for regulating pressure within the pressure vessel.

9. A separator according to claim 8, in which the pressure regulator comprises a flow controller for controlling flow through the first phase outlet.

10. A separator according to claim 1, wherein the separator comprises a plurality of vanes.

11. A separator according to claim 10, in which the vanes are flat circular discs that are coaxial with, and extend radially outwardly from, the separator axis.

12. A separator according to claim 10, in which the vanes are cone shaped discs that are coaxial with, and extend radially outwardly from, the separator axis.

13. A separator according to claim 11, in which each disc has an array of apertures arranged circumferentially about the separator axis, wherein the apertures of adjacent discs are angularly offset with respect to one another.

14. A separator according to claim 13, in which spacer fins extend between adjacent discs and the spacer fins are arranged with respect to the apertures to form staggered and/or interconnected flow passages from the pressure vessel inlet to the first phase outlet.

15. A separator according to claim 1, in which at least one emulsion outlet is disposed radially outwardly of the first phase outlet and radially inwardly of the second phase outlets.

16. A separator according to claim 15, in which the or each emulsion outlet comprises a tube which extends radially outwardly with respect to the separator axis, wherein the or each tube is in fluid communication with an emulsion discharge passage which extends along the separator and which exhausts through an end of the separator for removing emulsion from the separator.

17. A separator according to claim 1, further comprising a rotor shaft provided with spray nozzles for supplying fluid into the interior of the pressure vessel.

18. A separator according to claim 1, wherein the reference position is radially outward of the first phase outlet.

19. A separator according to claim 18, wherein the reference position is radially inward of the third phase outlet.

20. A separator according to claim 1, wherein the sample port comprises a density meter.

21. A separator according to claim 1, wherein the angle of inclination is at least 20 degrees with respect to the separator axis.

22. A separator according to claim 1, further comprising a sealable casing within which the pressure vessel is rotatably mounted, wherein the casing comprises a sump in the lower region of the casing from which the second phase is discharged.

23. A separator as claimed in claim 22, further comprising, means for introducing fluid between the casing and the pressure vessel.

24. A separator as claimed in claim 23, further comprising a pressure regulator for regulating pressure between the casing and the pressure vessel.

* * * * *